US008807605B1

(12) United States Patent
Dudley et al.

(10) Patent No.: US 8,807,605 B1
(45) Date of Patent: Aug. 19, 2014

(54) BI-SWING WAREHOUSE DOOR LATCH SYSTEM

(71) Applicants: David Edmond Dudley, Oregon City, OR (US); Simon David Dudley, Campbell, CA (US); Peter Bruce Dudley, Seattle, WA (US)

(72) Inventors: David Edmond Dudley, Oregon City, OR (US); Simon David Dudley, Campbell, CA (US); Peter Bruce Dudley, Seattle, WA (US)

(73) Assignee: Dudley Gates, San Jose, CA (US)

( * ) Notice: Subject to any disclaimer, the term of this patent is extended or adjusted under 35 U.S.C. 154(b) by 0 days.

(21) Appl. No.: 13/936,142

(22) Filed: Jul. 6, 2013

(51) Int. Cl.
*E05C 3/06* (2006.01)

(52) U.S. Cl.
USPC ..... 292/201; 292/DIG. 29; 292/341.17

(58) Field of Classification Search
USPC ..... 292/201, 314.17, DIG. 29
See application file for complete search history.

(56) References Cited

U.S. PATENT DOCUMENTS 5,492,382 A * 2/1996 McBride et al. ..... 292/341.17
6,010,168 A * 1/2000 Johnson ..... 292/341.17

* cited by examiner

*Primary Examiner* — Mark Williams
(74) *Attorney, Agent, or Firm* — Richard B. Main; Main Cafe

(57) ABSTRACT

A bi-swing warehouse door latch system installs an electro-mechanical lock horizontally in the door casings overhead. Each has two catches to drop down on either side of the door. The doors are allowed to swing open when the respective catches are unlatched by a solenoid. The doors are not allowed to swing open when the respective catches are held latched by another solenoid and a teeter arm. Battery powered models produce brief pulses to put the catches in their locked states or unlocked states using a capacitor to store enough energy after power is lost to kick the solenoids. Utility powered versions can be configured to automatically relax into locked or unlocked states when power is lost. The doors are controlled to unlock when those with authorized access are recognized.

8 Claims, 11 Drawing Sheets

BI-SWING WAREHOUSE DOOR LATCH SYSTEM

CO-PENDING APPLICATION

This application claims benefit of U.S. Provisional Patent Application Ser. No. 61/814,342, filed Apr. 22, 2013, and titled BI-SWING WAREHOUSE DOOR LATCH SYSTEM, by David Dudley, Simon Dudley, and Peter Dudley.

BACKGROUND OF THE INVENTION

1. Field of the Invention

The present invention relates to electro-mechanical door locks, and more particularly to automatic security systems for large bi-swing warehouse doors that will allow employees wearing company badges quick, hands-free access.

2. Description of Related Art

Train, airline, bus, and other transportation stations all employ gates and turnstiles to control and secure various areas. These gates very often have to be able to swing both ways and yet be able to latch securely. Station agents in secure booths need to be able to unlock the gates briefly to let authorized riders and ticketholders through. Very often the way this is done in conventional systems is to use an electro-mechanical lock mechanism at the gate with wires buried in the ground or installed in the floors and walls connected to a control switch in the secure booth.

Such lock systems must survive energetic efforts by criminals to kick the gates down, and still be failsafe in the event of a power failure. The gates must unlatch when power is lost so as to not trap people from escape.

David Dudley describes such a locking mechanism for a bi-swing train station gate in U.S. Pat. No. 8,186,729, issued May 29, 2012, titled TRAPLOCK FOR BI-SWING GATE (Dudley '729).

When two large bi-swing doors are used together, such as in large liquor distribution warehouses, there is no vertical post in which a Traplock like that described by Dudley '729 can be installed. Such Traplock will not work if it is installed horizontally in the overhead door casings because the solenoids and latches will be pulled into a lockup situation by the new ways gravity is acting on them.

As an example of an installation, the FRANK ColdSwing Double Acting Cold Storage Door is used for personnel, hand truck and pallet jack traffic. The design provides quick and easy, hands-free access between separated environmentally controlled spaces. It facilitates continuous movements of people, hand trucks, and pallet jack traffic in cooler applications. These doors have windows in them, and match the performance of more traditional cold storage doors. See, frankdoor.com/product_line_double_acting_doors.php There is also a need to minimize the construction expense of having to retrofit new locking systems into existing warehouse buildings and security doors. Not having to replace or modify the existing doors is a primary consideration. Tearing up concrete or tiled floors to lay wires is also just out of the question.

SUMMARY OF THE INVENTION

Briefly, a bi-swing warehouse door latch system embodiment of the present invention comprises an electro-mechanical lock installed horizontally in the overhead door casings just short of each distal end of each heavy bi-swing security door. Each electro-mechanical lock has two catches that can drop down on either side of the door to prevent its opening.

The electro-mechanical locks are installed in pockets above the doors such that the doors will cover and protect them when the doors are in their locked positions. The doors are allowed to swing open when the respective catches are unlatched by a solenoid. The doors are not allowed to swing open when the respective catches are held latched by another solenoid and teeter arm. Such solenoids are arranged in battery powered models to require only brief pulses of power to put the catches in their locked states or unlocked states. A capacitor is employed to store enough energy after power is lost to kick the solenoids into the unlocked state. In battery operated models, a low voltage condition caused by the battery dying will cause a shutdown that includes pulsing the unlatch solenoid so the teeter arm will be pulsed out of the way and springs can withdraw the catches into the pockets. Wireless controls and RFID readers are used to unlock the doors when those with authorized access are recognized.

The above and still further objects, features, and advantages of the present invention will become apparent upon consideration of the following detailed description of specific embodiments thereof, especially when taken in conjunction with the accompanying drawings.

DETAILED DESCRIPTION OF THE INVENTION

Figure 1A:
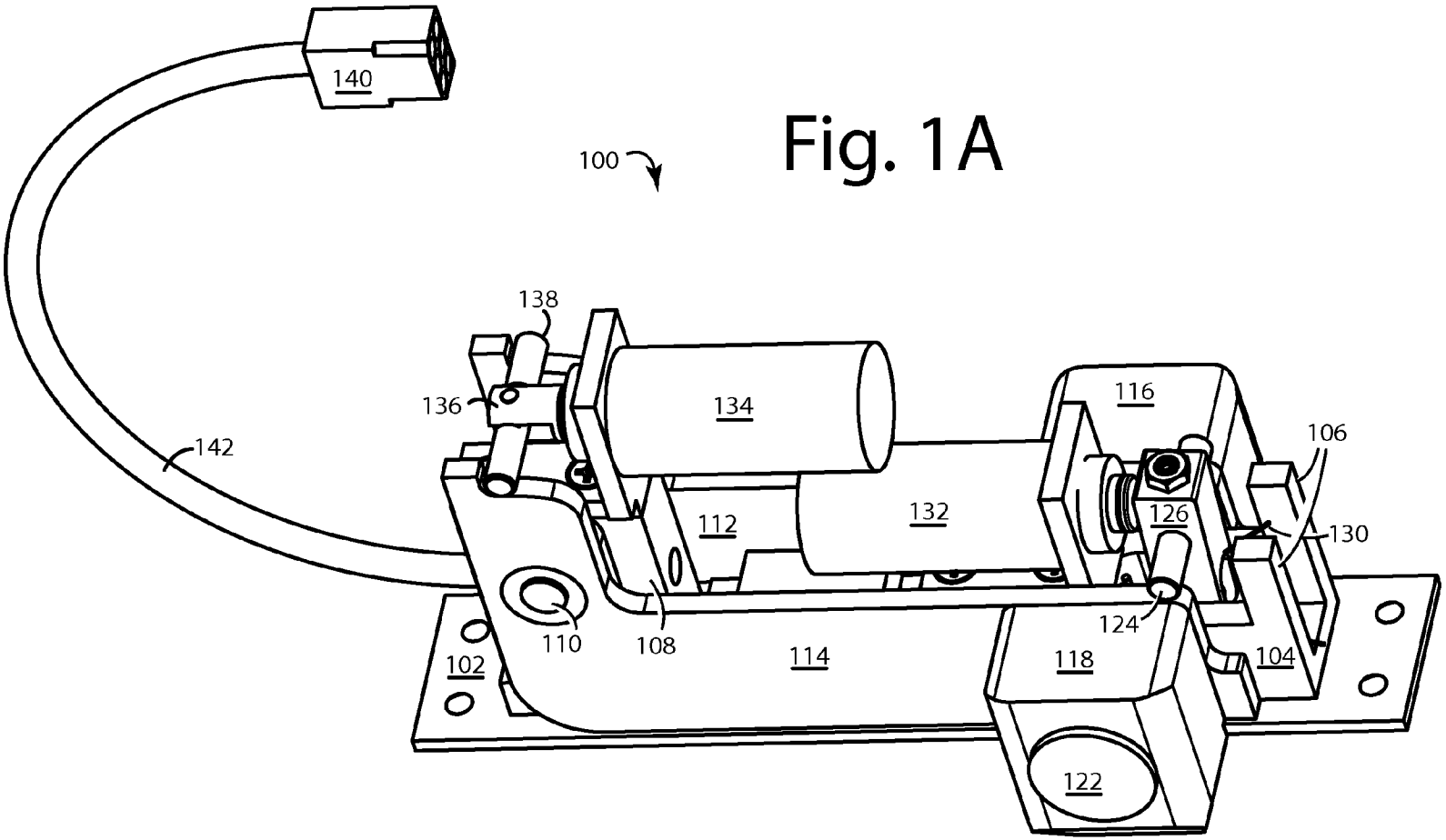
FIGS. 1A-1F are various perspective view diagrams of a double-acting door lock in a utility powered embodiment of the present invention.

Door latch system embodiments of the present invention comprise an electro-mechanical lock installed horizontally in the overhead door casings of tandem double-action impact traffic doors. These are placed near the middle at the distal ends of each bi-swinging door in pockets in the overhead casings for maximum leverage on the doors and hands-free operation.

Each electro-mechanical lock has two catches that can drop down and lock on either side of the door to prevent the door opening. The electro-mechanical locks are installed in pockets above the doors such that the doors will cover and protect them when the doors are in their locked positions. A sensor reports when the door is open. The doors are allowed to swing open when the respective catches are unlatched by a solenoid or electro-mechanical actuator. As the door is opened, the catches drop back down to catch the door when it automatically recloses.

The doors are not allowed to swing open when the respective catches are held latched by a second solenoid and a teeter arm. Such solenoids are arranged in battery powered models to require only brief pulses of power to put the catches in their locked states or unlocked states. A capacitor is employed to store enough energy after power is lost to kick the solenoids into the unlocked state. In battery operated models, a low voltage condition caused by the battery dying will cause a shutdown that includes pulsing the unlatch solenoid so the teeter arm will be pulsed out of the way and springs can withdraw the catches into the pockets. The doors are unlocked when those with authorized access are recognized. Wireless and wired controls, and even RFID badge readers can be used to unlock the doors.

FIGS. 1A-1F represent a double-acting door lock embodiment of the present invention, and is referred to herein by general reference numeral 100. The lock 100 is built on a base plate 102 that screws into a door casing pocket. A frame 104 is mounted to the base plate 102 and has a pair of keeper tabs 106 and a pivot bulkhead 108. A pivot shaft 110 on bearings passes through two catch arms 112 and 114. These arms have limited motion and carry catch blocks 116 and 118 on their respective distal ends. A rubber cushion 120 and 122 are attached on the outside faces of catch blocks 116 and 118.

The motion of the two catch arms 112 and 114 is limited at one extreme by base plate 102. When catch arms 112 and 114 contact base plate 102 along their bottom lengths, the catch blocks 116 and 118 will protrude to their maximum extent out of the door casing pocket to capture the top edge of an adjacent bi-swing door. Gravity will ordinarily cause the catch arms 112 and 114 to drop into the locked position of FIG. 1A. The motion of the two catch arms 112 and 114 is limited at the other extreme by a teeter pin 124.

Figure 1B:
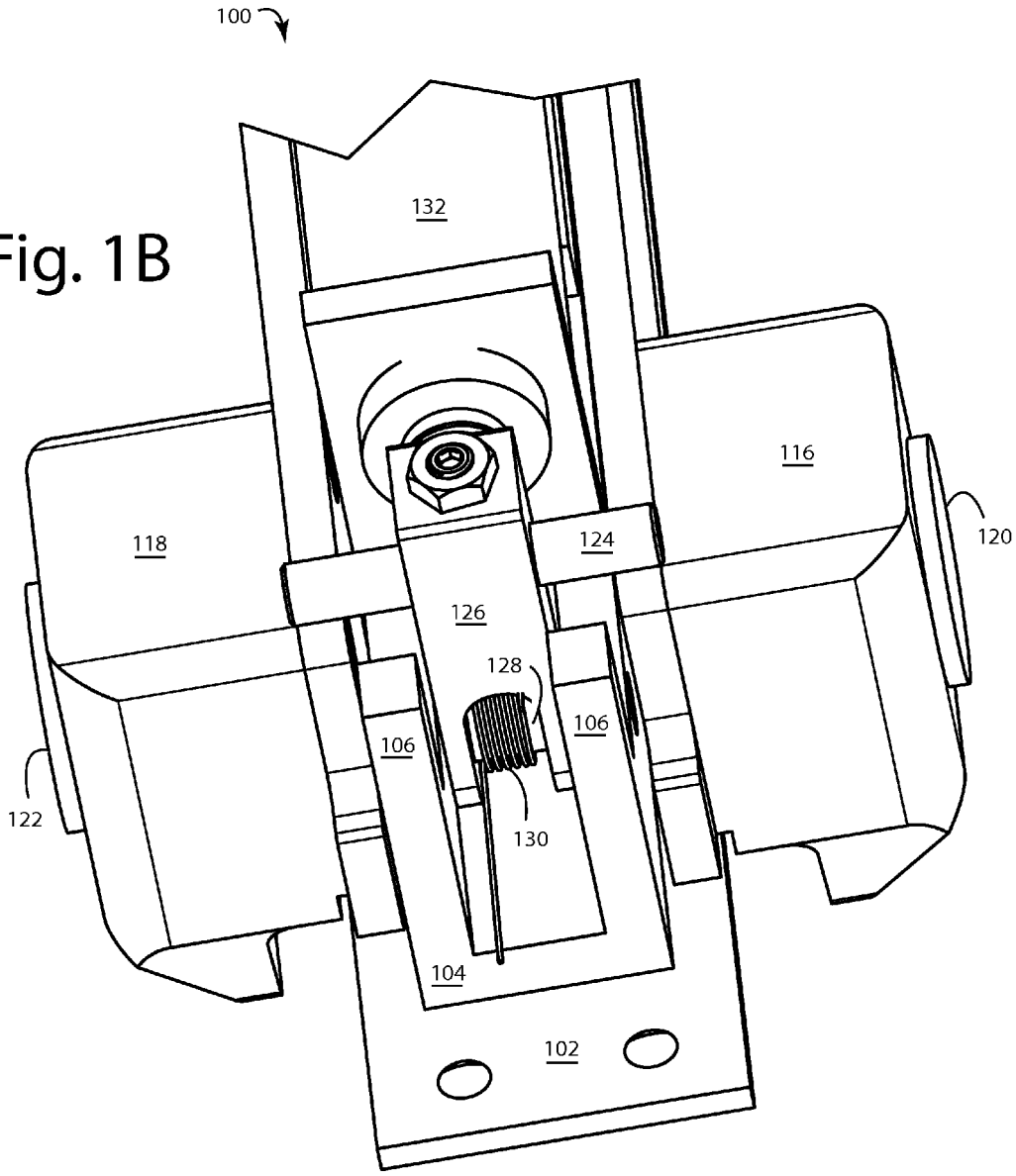
Figure 1C:
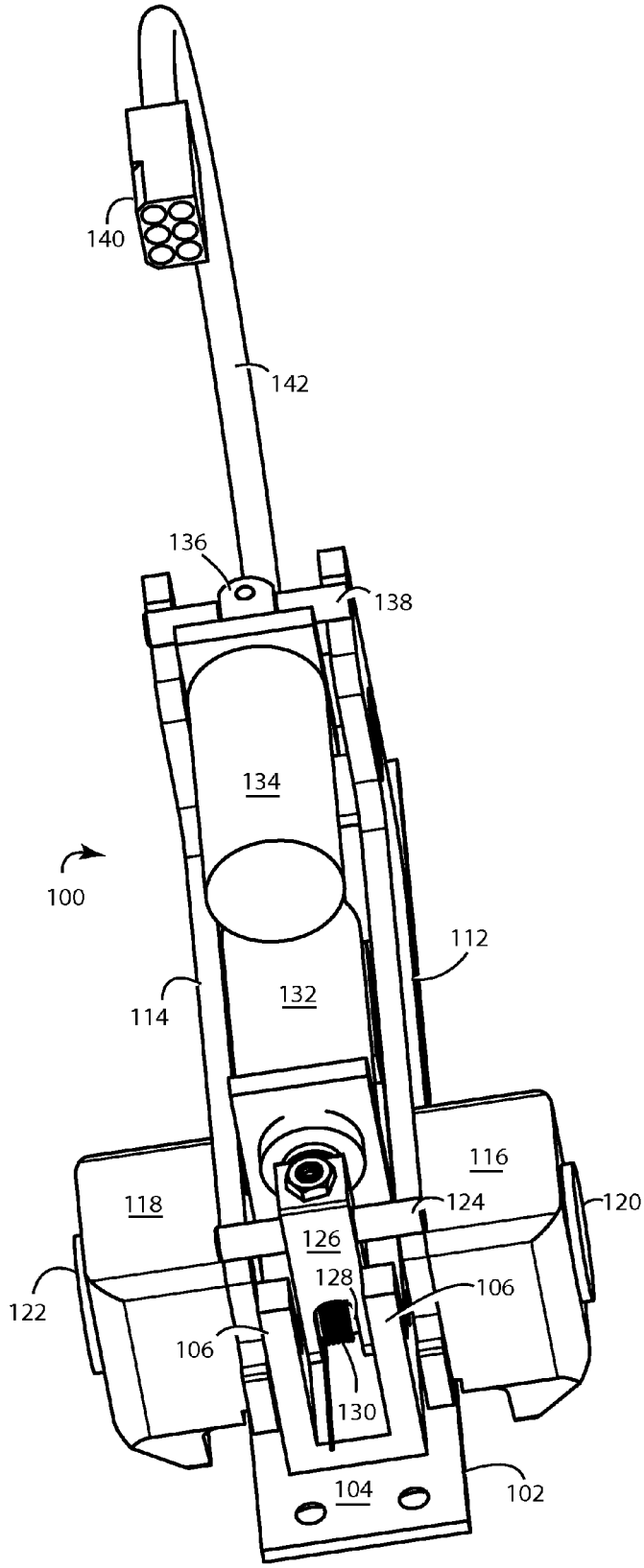

Teeter pin 124 is carried by a teeter arm 126 that can teeter back and forth on a shaft 128 (FIGS. 1B, 1C). A torsion spring 130 mounted on shaft 128 presses the teeter arm and the teeter pin 124 it carries against the top distal corner of catch arms 112 and 114. If the catch arms 112 and 114 are in the position shown in FIG. 1A, the teeter pin will ride over the top and lock catch arms 112 and 114 so they cannot move up to unlock.

Figure 1D:
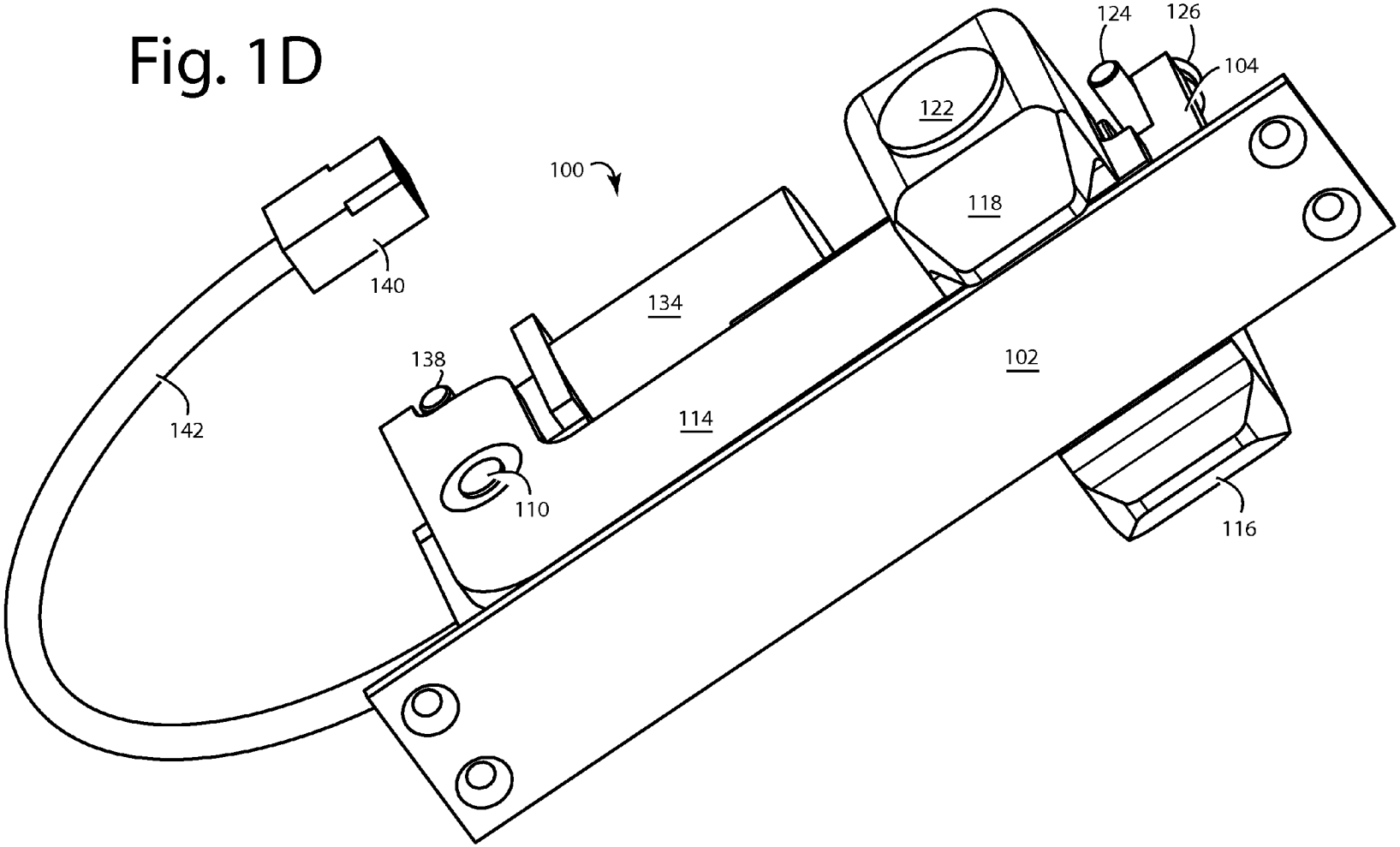
Figure 1E:
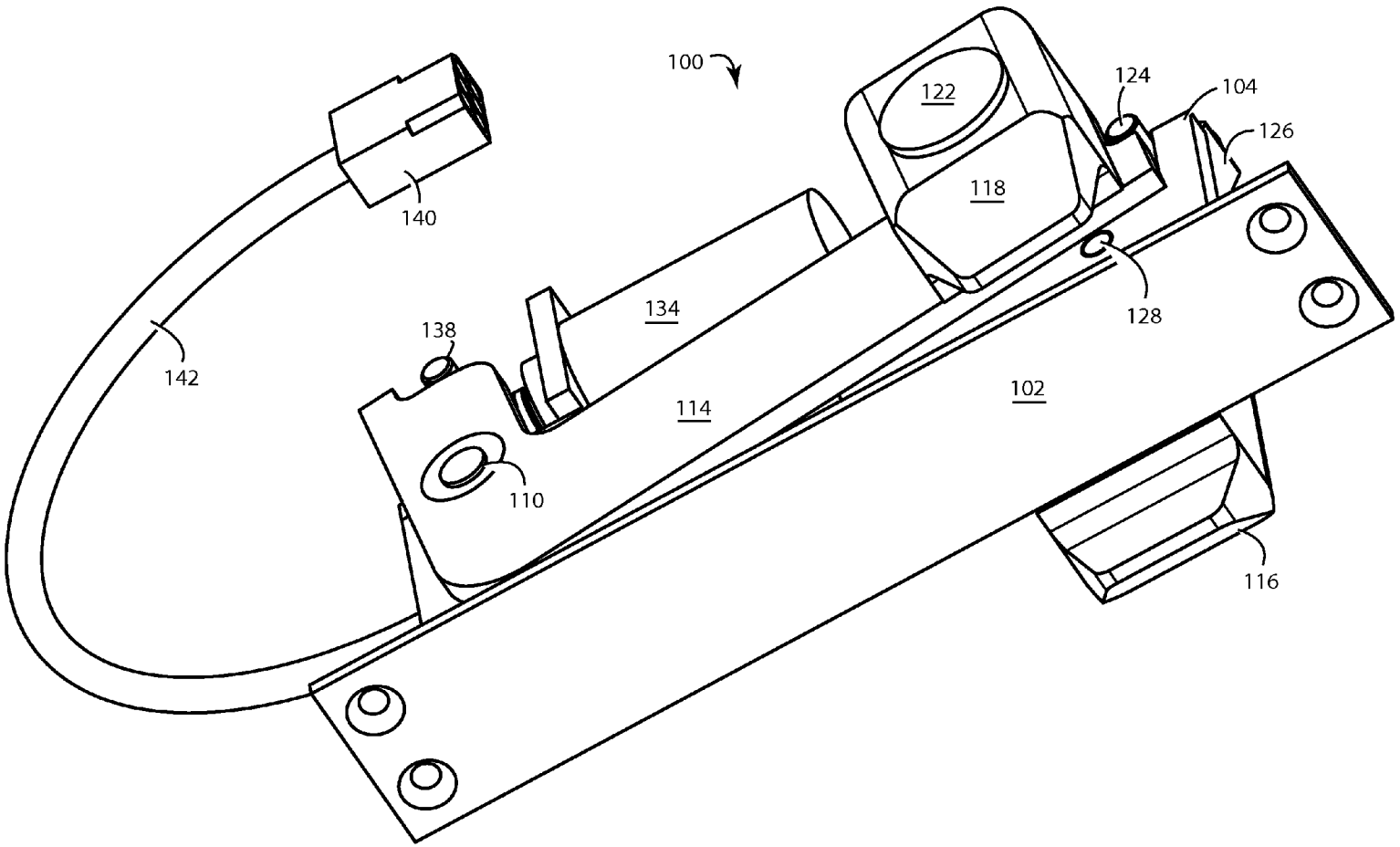
Figure 1F:
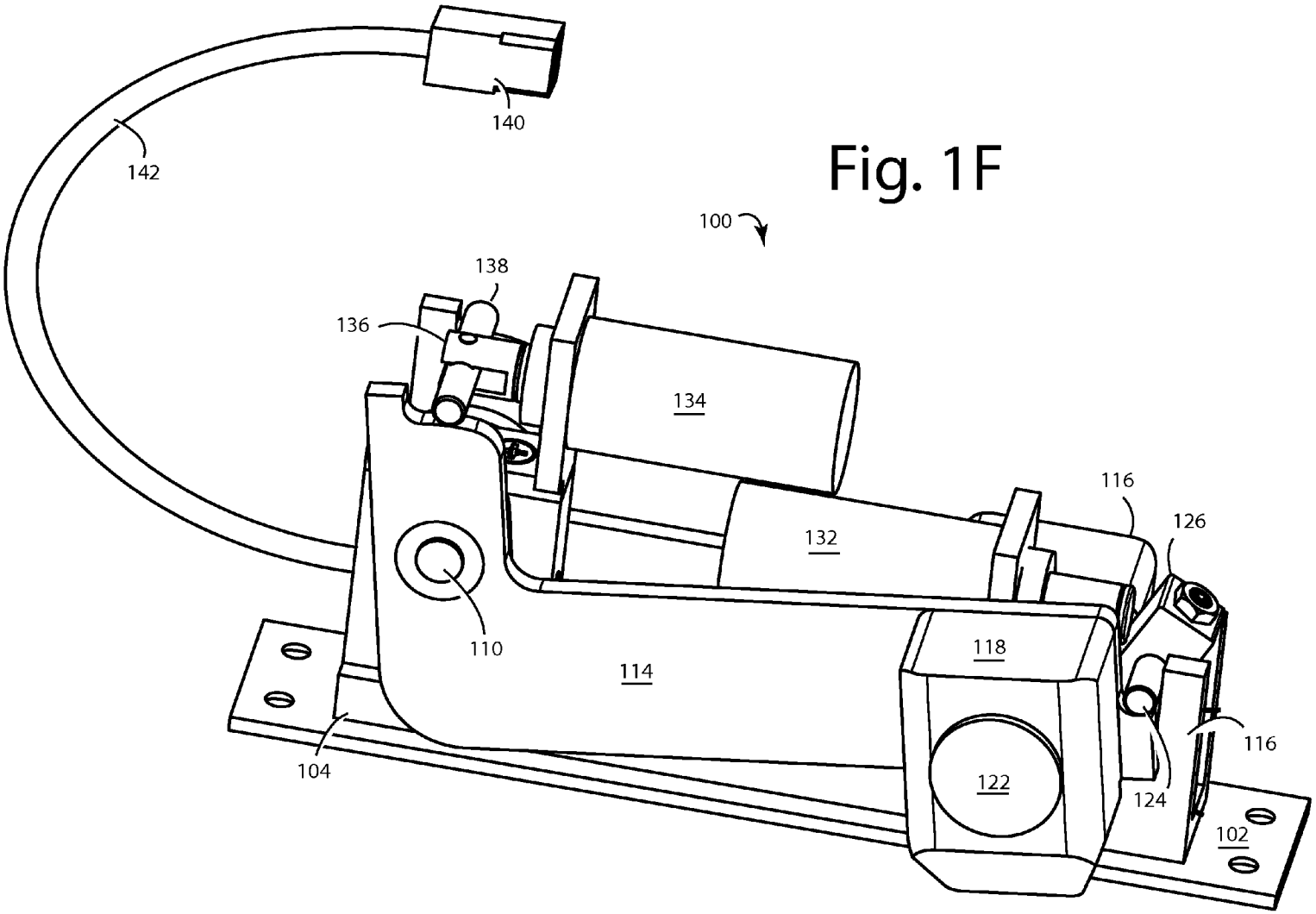

But, if either of catch arms 112 and 114 are in their raised position, such as is shown in FIG. 1F, teeter pin 124 cannot get over to lock down catch arms 112 and 114.

A fail safe lock embodiment shown in FIGS. 1D-1F represents a hard-wired, utility powered version in which its teeter arm solenoid is normally extended by a spring. Such unlocks the arms. A fail secure version of the hard wired lock would employ a normally retracted solenoid like the one shown in FIG. 2A-D A teeter solenoid 132 has an armature normally extended by a spring. When the solenoid is de-energized, the spring is allowed to push the armature out against the teeter arm 126, causing teeter pin 124 to unlatch from the tops of catch arms 112 and 114. FIGS. 1D-1F show teeter solenoid 132 de-energized and teeter arm 126 pushed over. Catch arms 112 and 114 are enabled to raise if a catch arm solenoid 134 is also de-energized. An internal spring is provided to push out a clevis 136 mounted with a bridge pin 138.

In battery powered embodiments, door lock 100 is configured to have two stable conditions that require no power to maintain. One is a failsafe mode that unlocks the doors when utility power fails or the battery runs down. The other is the locked condition that keeps the doors closed as long as the control electronics are operating normally.

However, FIGS. 1A-1F show the alternative utility powered embodiment in which power is used to maintain the locked condition. Such is not always the case or desirable. Particular secure applications may require the locks, their solenoids, and springs to be configured to automatically lock and stay locked if power is lost. This would be appropriate were no workers or members of the public would become trapped or endangered by such a configuration.

Connections are made to a lock controller using a connector 140 and a pigtail lead 142. For example, lock controller 320 in FIG. 3.

FIGS. 2A-2D represent a bi-swing door locking installation 200 in a battery powered embodiment of the present invention that uses a lock similar to lock 100 of FIGS. 1A-1F. The main differences are in which directions the solenoids will move when energized, and in the respective positions the internal springs will return them to. All embodiments can be configuration to be fail-safe (doors unlock) or fail-secure (doors lock) upon power failure.

A part of a door casing 202 is illustrated with a pocket 204 positioned overhead of a double acting swing door 206. A catch solenoid 210 and a teeter solenoid 212 are arranged to work in cooperation. An armature 214 on solenoid 210 is configured to push catch arms 216 so that they will lift up catches 218 and unlock door 206 for either direction.

In fail safe embodiments, springs internal to catch solenoid 210 will do the lifting, and energizing solenoid 210 will allow catches 218 to drop down into their locked positions. Fail secure embodiments work the opposite sense, energizing solenoid 210 will lift catches 218 into their unlocked positions, and springs internal to the catch solenoid will drop them down. In order to require no power to maintain the lock or un-locked conditions, a normally retracted solenoid 212 is used to move a teeter arm 220.

Bevels or ramps on either side of the catches 218 allow the doors to reclose, if they were opened, by allowing the top door edges to push up catches 218 on the door's return to its closed position. Gravity will drop the catches 218 back down as they clear the top of door 206, and teeter 220 can lock them if its moved (left as in FIG. 2B). So if a door unlock is requested, any power applied to the solenoids 210 and 212 to unlock the doors need only be applied as long as door 206 is still closed. Once it's moved open the solenoid power can be withdrawn. A reed switch 222 or other door-closed sensor can be used with appropriate logic to realize this kind of operation.

Figure 2A:
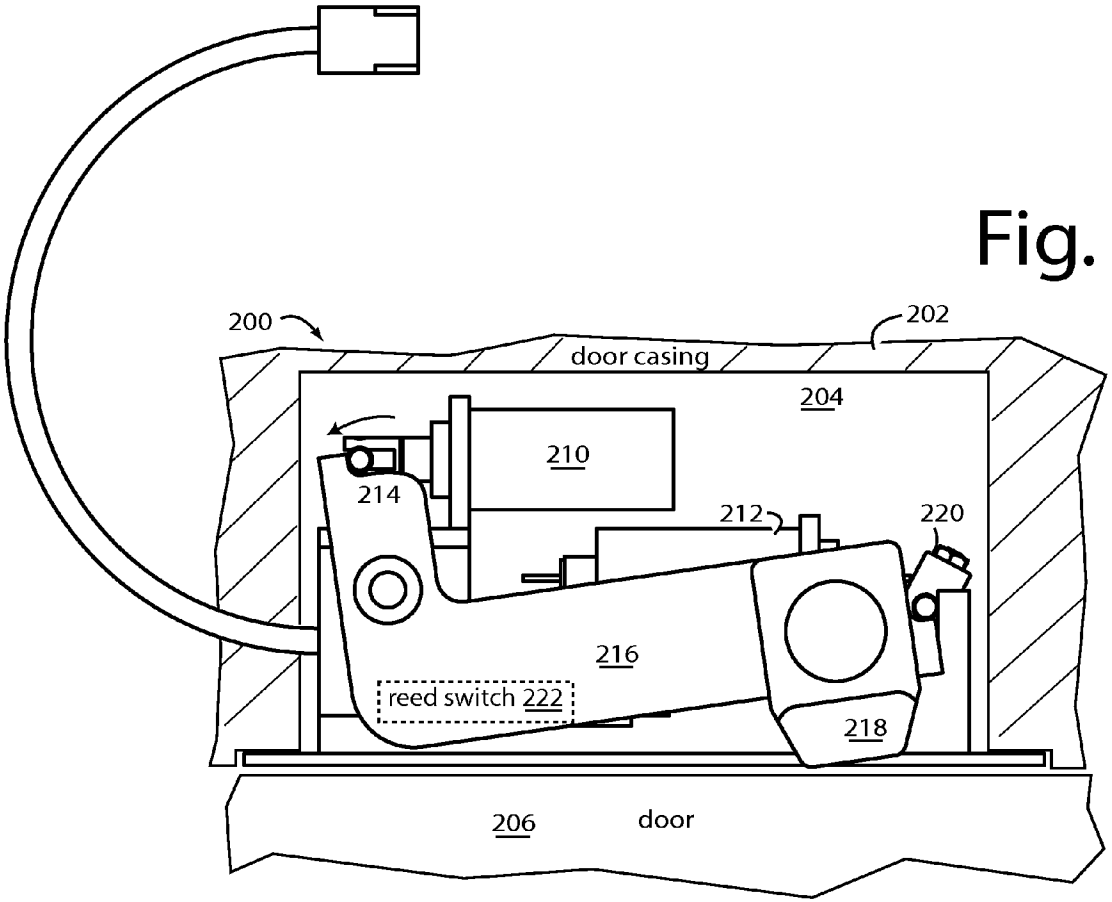
FIGS. 2A-2D are cutaway, side view diagrams of a bi-swing door locking installation in a battery powered embodiment of the present invention that uses a lock similar to the lock of FIGS. 1A-1F, but where the teeter arm solenoid is a normally retracted type.

FIG. 2A represents one of two stable conditions that can be maintained without power being applied to either of solenoids 210 or 212. When solenoid 210 is de-energized, an internal spring will push armature 214 out (to the left in FIG. 2A) and force catch arm 216 to lift up catch 218. Once catch 218 is retracted up into pocket 204, door 206 is free to swing (in and out of the page in the views provided in FIGS. 1A-1D). This, therefore is the unlocked condition.

Figure 2B:
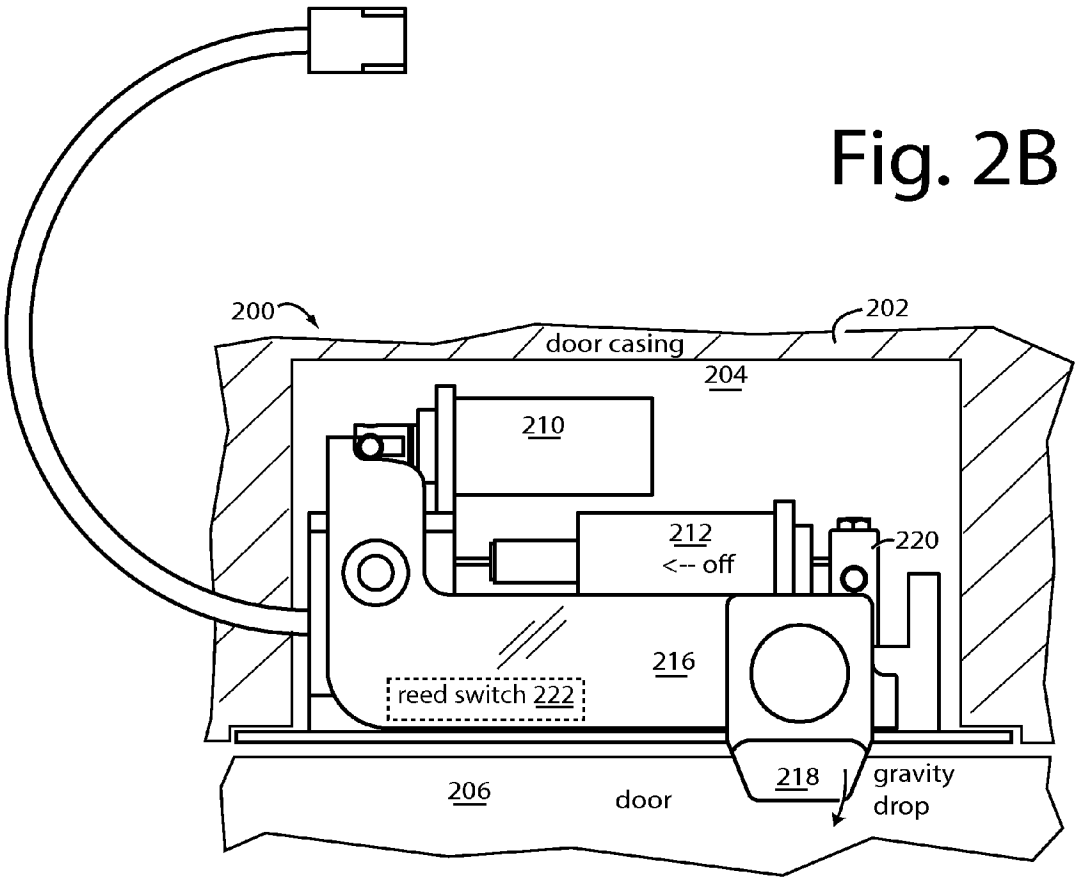

Catch arm 216 will not be able to lift up if teeter arm 220 has captured it as shown in FIG. 2B. A momentary pulse of power to solenoid 212 can be used kick teeter arm 220 over (to the right in FIG. 2B) long enough to allow catch arm 216 to lift up into the position shown in FIG. 2A.

FIG. 2B represents the other stable condition that can be maintained without power being maintained to either of solenoids 210 or 212. A torsion spring (only seen in FIG. 1B as spring 130) is able to pull back teeter arm 220 into the position shown in FIG. 2B whenever solenoid 212 is de-energized. This, therefore is the locked condition.

Figure 2C:
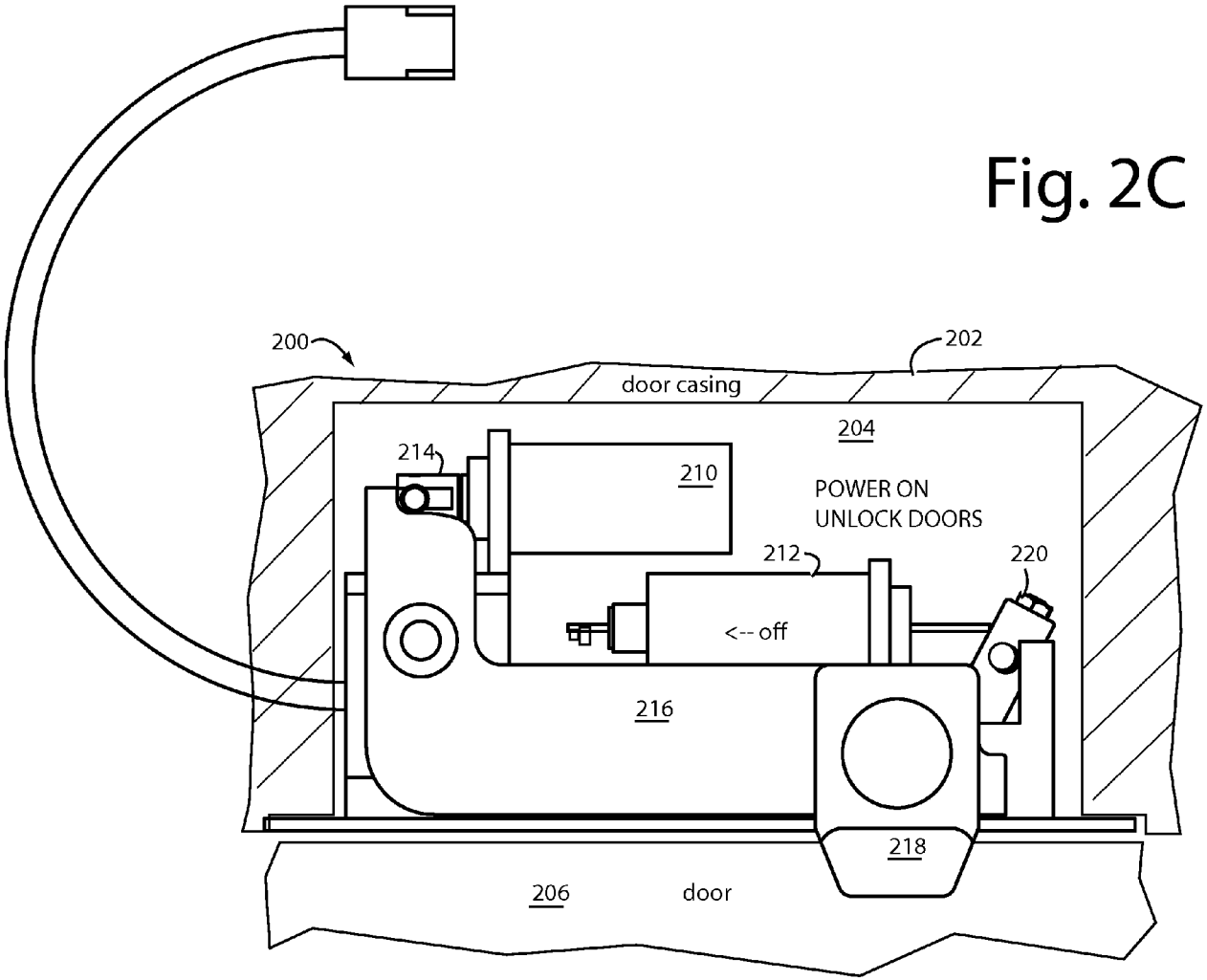

FIG. 2C represents when power is normal and the doors are to be unlocked. First, solenoid 212 is energized as shown, pushing (right in FIG. 2C) against its internal spring to move teeter 220 out of the way of catch arm 216.

Figure 2D:
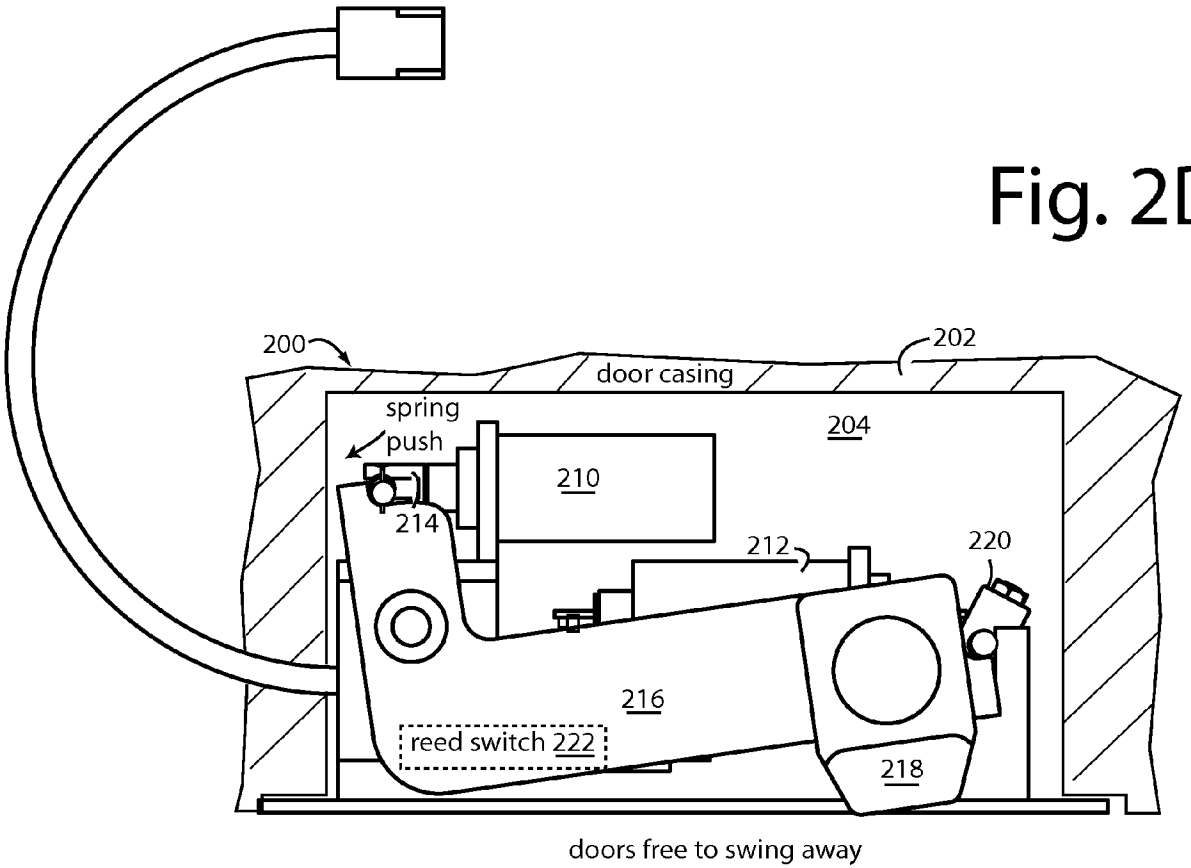

FIG. 2D represents a final step of lifting catch arms 216 up with catches 218 to thereby allow doors 206 to open.

Figure 3:
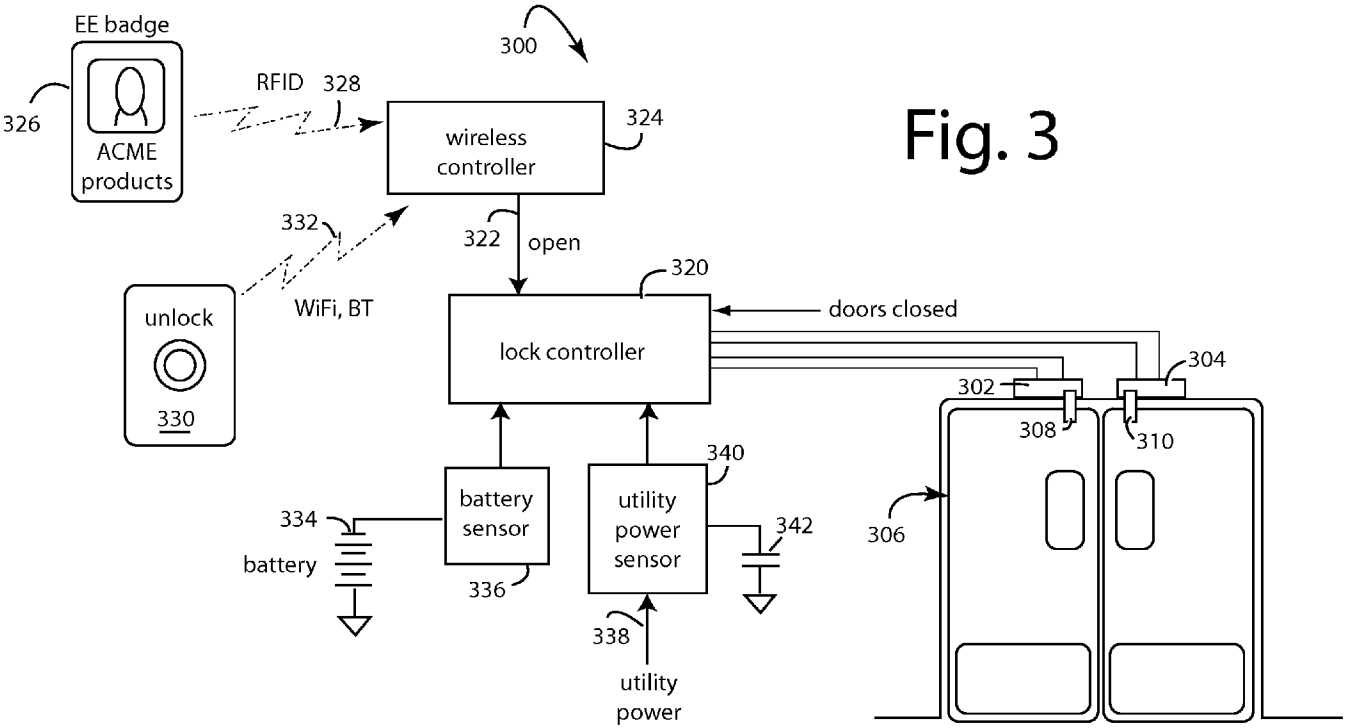
FIG. 3 is a functional block diagram of a retail store warehouse door security system in an embodiment of the present invention.

FIG. 3 represents a retail store warehouse door security system in an embodiment of the present invention, and is referred to herein by general reference numeral 300. The retail store warehouse door security system 300 places overhead door lock assemblies 302 and 304 in pockets in the door casing above a tandem set of double-acting swing doors 306. Each door lock assembly 302 and 304 controls respective catches 308 and 310 that can be electro-mechanically lifted to allow the doors to be pushed and swung open. Such tandem set of double-acting swing doors 306 would typically be found in a large grocery or liquor store with a front retail area for the public and a back warehouse only accessible to authorized employees. The doors thus separate the retail and warehouse areas.

Ideally, authorized employees would be automatically detected when they head toward doors 306 and immediately allowed hands-free access, in or out of the warehouse. Retail customers, however, should be prevented from getting into or out of the warehouse. The locks 302 and 304 need to be strong enough to resist serious attempts to bust through, and yet failsafe such that if power fails the locks will unlatch without human intervention. In alternative embodiments, the system is configured to be "fail secure", by simply not sending pulses to the teeter arm solenoid after a loss of power.

A solid-state electronics lock controller 320 includes digital logic circuits to coordinate and control two each solenoids in the overhead door lock assemblies 302 and 304. Such solenoids are configured like those illustrated in FIGS. 1A-1F and FIGS. 2A-2D. An "open" command 322 is received from a hardwired emergency exit button or by a wireless receiver 324 from either an RFID equipped employee badge 326 over an RFID response 328, or from an unlock remote control 330 using a Wi-Fi, Bluetooth, or other radio link 332. Lock controller 320 can be installed in its own pocket in the door casings.

Control units for battery systems should be configured to first warn the user that the battery needs changing. They should then open the lock if the battery voltage falls below a minimum level. A capacitor can be incorporated as well to provide a failsafe source of short term power should the battery be suddenly disconnected.

In some embodiments locks 302 and 304 must be failsafe due to the demands of the application, that is they must lift catches 308 and 310 when a utility power failure or battery failure occurs. For example, in battery operated applications, a common rechargeable battery 334 like those used for power tools is provided with a battery sensor 336. When a low voltage condition occurs, like is common just before a battery depletes completely, the lock controller 320 is signaled to kick locks 302 and 304 open.

In non-battery operated embodiments, two identical "normally extended" solenoids are provided to unlock and raise the arms when power is lost. So there would be no need for a capacitor. The capacitors are generally included in battery operated embodiments.

A utility powered fail-secure embodiment includes a normally retracted catch arm solenoid that requires a capacitor for power to re-lock the doors if they happened to be opened when the power was lost.

In non-battery operated models, 110-VAC utility power 338 is connected to a power sensor 340 which keeps a standby capacitor 342 charged. When the utility power fails, the lock controller 320 is signaled to kick locks 302 and 304 open. The energy needed to do that is supplied by capacitor 342. Only a shot or two on the appropriate solenoids is needed to do the trick. Preferably, 110-VAC utility powered embodiments are made failsafe without the need for a capacitor. Teeter arm solenoid is configured to be powered to hold the doors locked. When utility power is lost, the teeter arm will naturally retract under pressure from a spring. The teeter arm is held in its locked position by the torsion spring, and is pushed in to an unlocked position by a stronger internal solenoid spring.

Figure 4:
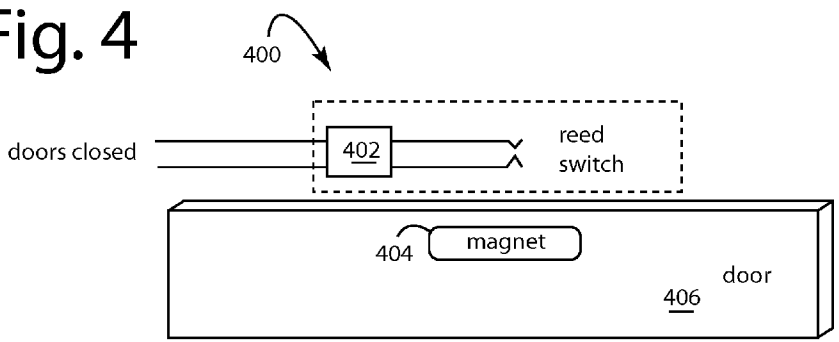
FIG. 4 is a schematic diagram of a door closed sensing circuit that can be used to provide a switch contact to a lock controller as in FIG. 3.

FIG. 4 represents a door closed sensing circuit 400 that can be used to provide a switch contact to lock controller 320 (FIG. 3). When locks 302 and 304 are released, doors 306 are free to swing away. The locks should not be allowed to latch back up until the doors return. In FIG. 4, a reed switch sensitive to magnetic fields is placed in the door casings or locks themselves. A permanent magnet 404 is mounted in a swinging door 406 such that it can operate reed switch 402 when the door is in its closed position. Other types of conventional switches and sensors are also possible.

It may be necessary to mount an additional electro-mechanical lock in the door or the floor below it. A trap-lock at the top of the door can catch and center the door, an electric dead bolt mounted in the floor may be configured in some embodiments to go into a strike plate located in the center of the door. An electric strike could also be installed in the bottom of the door itself, and have its bolt operate into a hole in the floor.

Although particular embodiments of the present invention have been described and illustrated, such is not intended to limit the invention. Modifications and changes will no doubt become apparent to those skilled in the art, and it is intended that the invention only be limited by the scope of the appended claims.

The invention claimed is:

1. A bi-swing warehouse door latch system, comprising:

an electro-mechanical lock comprising a frame mounted to a rectangular base plate and configured for flush mounting inside a pocket disposed in an horizontal overhead portion of a door casing matching a pair of bi-swing double doors;

a pair of catch arms connected by a pivot shaft that passes through the frame and arranged such that a corresponding catch block on each of the distal ends of the catch arms are able to drop under the force of gravity to protrude downward past opposite edges of the base plate and to be actively returned inside the door casing above the base plate;

a catch arm solenoid mounted to the frame between the two catch arms and mechanically connected such that an electrical activation will cause the catch blocks to be electro-mechanically lifted up inside the door casing above the base plate;

a teeter arm mounted to the frame between the two catch arms and mechanically connected to them such that the two catch blocks can be locked in position after being dropped and protruding down out from the door casing past the base plate;

a teeter solenoid mounted to the frame between the two catch arms and mechanically connected to push or pull the teeter arm into or out of a locking position when electrically activated;

wherein, each door of the pair of bi-swing double doors is configured to be able to swing open in either direction when the respective catches are unlatched by activating the catch arm solenoid, and are not allowed to swing open when the respective catches are held latched by activating the teeter solenoid.

2. The system of claim 1, wherein, the catch arm and teeter solenoids are each mutually arranged with a corresponding spring to require only brief pulses of electrical battery power to put the catch arms in their locked or unlocked states.

3. The system of claim 1, further comprising:

a capacitor configured to store electrical energy to kick the catch arm and teeter solenoids into one of their locked or unlocked states.

4. The system of claim 1, further comprising:

a battery sensor configured to detect a low voltage condition caused by a battery dying and configured to power pulse the catch arm and teeter solenoids into a locked or unlocked state.

5. The system of claim 1, further comprising:

a wireless controller and lock controller electrically connected to the catch arm and teeter solenoids, and configured to unlock the bi-swing double doors when a badge is electronically recognized.

6. The system of claim 1, wherein:

the electro-mechanical locks are installed in pockets above the bi-swing double doors in protected and covered positions when the swing doors are in their locked positions.

7. The system of claim 1, further comprising:

a lock controller, battery, and battery sensor electrically connected to the catch arm and teeter solenoids, and configured to warn the battery needs changing, and to trigger the catch arm and teeter solenoids into one of their locked or unlocked states if the battery voltage falls below minimum levels; and a capacitor included connected to the lock controller to provide a failsafe source of electrical power should the battery be disconnected.

8. The system of claim 1, further comprising:

a permanent magnet disposed in a top edge of each swing door; and a door-closed sensor disposed in a pocket above the bi-swing double doors and providing a switch contact output for a lock controller so the electro-mechanical locks are not be allowed to latch back up until the bi-swing double doors return to their closed positions.

* * * * *